US011905048B2

(12) United States Patent
Suolahti et al.

(10) Patent No.: US 11,905,048 B2
(45) Date of Patent: Feb. 20, 2024

(54) WRAPPING MACHINE WITH A ROPING ASSEMBLY

(71) Applicant: Signode Industrial Group LLC, Glenview, IL (US)

(72) Inventors: Yrjö Suolahti, Mynämäki (FI); Martti Anttonen, Raisio (FI); Niko Aarras, Turku (FI)

(73) Assignee: Signode Industrial Group LLC, Tampa, FL (US)

( * ) Notice: Subject to any disclaimer, the term of this patent is extended or adjusted under 35 U.S.C. 154(b) by 490 days.

(21) Appl. No.: 17/053,105

(22) PCT Filed: Jun. 19, 2019

(86) PCT No.: PCT/US2019/037918
§ 371 (c)(1),
(2) Date: Nov. 5, 2020

(87) PCT Pub. No.: WO2019/246210
PCT Pub. Date: Dec. 26, 2019

(65) Prior Publication Data

US 2021/0139175 A1 May 13, 2021

Related U.S. Application Data

(60) Provisional application No. 62/688,720, filed on Jun. 22, 2018.

(51) Int. Cl.

| | |
|---|---|
| ***B65B 11/06*** | (2006.01) |
| ***B65B 11/58*** | (2006.01) |
| ***B65B 11/00*** | (2006.01) |
| ***B65B 11/02*** | (2006.01) |
| ***B65B 41/16*** | (2006.01) |

(52) U.S. Cl.
CPC ..... *B65B 11/585* (2013.01); *B65B 11/006* (2013.01); *B65B 11/025* (2013.01); *B65B 41/16* (2013.01)

(58) Field of Classification Search
USPC ..... 53/461
See application file for complete search history.

(56) References Cited

U.S. PATENT DOCUMENTS

| | | | |
|---|---|---|---|
| 4,255,918 | A | 3/1981 | Lancaster et al. |
| 4,271,657 | A | 6/1981 | Lancaster et al. |
| 4,336,679 | A | 6/1982 | Lancaster et al. |
| 4,418,510 | A | 12/1983 | Lancaster |
| 4,432,185 | A | 2/1984 | Geisinger |

(Continued)

FOREIGN PATENT DOCUMENTS

| | | | |
|---|---|---|---|
| CA | 2287675 | A1 | 4/2001 |
| EP | 0511870 | A1 | 11/1992 |
| WO | 2009108244 | A1 | 9/2009 |

OTHER PUBLICATIONS

"International Search Report and Written Opinion", From PCT/US2019/037918 (14 pages), dated Aug. 20, 2019.

*Primary Examiner* — Chinyere J Rushing-Tucker
(74) *Attorney, Agent, or Firm* — Neal, Gerber & Eisenberg LLP

(57) ABSTRACT

Various embodiments of the present disclosure provide a wrapping machine (1) that includes a roping carriage (300) configured to manipulate a sheet of film into a reduced-width rope form to secure a load (L) of goods to a pallet (P).

13 Claims, 15 Drawing Sheets

(56) References Cited

U.S. PATENT DOCUMENTS

| | | | | |
|---|---|---|---|---|
| 4,563,863 | A | 1/1986 | Humphrey | |
| 4,587,796 | A | 5/1986 | Haloila | |
| 4,807,427 | A * | 2/1989 | Casteel | B65B 11/006 53/389.2 |
| 4,905,451 | A | 3/1990 | Jaconelli et al. | |
| 5,031,771 | A | 7/1991 | Lancaster | |
| 5,107,657 | A | 4/1992 | Diehl et al. | |
| 5,203,136 | A | 4/1993 | Thimon et al. | |
| 5,515,973 | A | 5/1996 | Sharp | |
| 5,517,807 | A | 5/1996 | Morantz | |
| 5,787,691 | A | 8/1998 | Turfan et al. | |
| 6,195,961 | B1 | 6/2001 | Turfan | |
| 6,360,512 | B1 * | 3/2002 | Marois | B65B 11/025 53/399 |
| 6,745,544 | B2 | 6/2004 | Matsumoto | |
| 6,955,027 | B2 | 10/2005 | Suolahti | |
| 7,707,802 | B2 | 5/2010 | Forrest | |
| 8,046,975 | B1 | 11/2011 | Bison | |
| 2004/0244336 | A1 * | 12/2004 | Suolahti | B65B 11/045 53/587 |

* cited by examiner

WRAPPING MACHINE WITH A ROPING ASSEMBLY

PRIORITY

This application is a national stage application of PCT/US2019/037918, filed on Jun. 19, 2019, which claims priority to and the benefit of U.S. Provisional Patent Application No. 62/688,720, filed Jun. 22, 2018, the entire contents of which are incorporated herein by reference.

FIELD

The present disclosure relates to wrapping machines, and more particularly to a wrapping machine that includes a roping carriage configured to manipulate a sheet of film into a reduced-width rope form to secure a load of goods to a pallet.

BACKGROUND

Several types of known wrapping machines use stretch wrap to prepare palletized loads of goods for shipment. These wrapping machines include a film carriage to which a roll of stretch film is mounted. These wrapping machines cause relative rotation between the film carriage and the load and relative vertical movement between the film carriage and the load to wrap the load with the stretch film in a spiral pattern. For instance, a turntable wrapping machine rotates a turntable on which the load is positioned while vertically moving the film carriage to wrap the load with the stretch film in a spiral pattern. A ring wrapping machine rotates the film carriage on a circular ring positioned around the load while vertically moving the film carriage to wrap the load with the stretch film in a spiral pattern. A rotating arm wrapping machine rotates a cantilevered arm—to which the film carriage is mounted—around the load while vertically moving the film carriage to wrap the load with the stretch film in a spiral pattern.

SUMMARY

Various embodiments of the present disclosure provide a wrapping machine that includes a roping carriage configured to manipulate a sheet of film into a reduced-width rope form to secure a load of goods to a pallet.

Certain embodiments of the wrapping machine of the present disclosure comprise a frame that defines a wrapping area; and a wrapping assembly positioned at least partially within the wrapping area. The wrapping assembly comprises a carriage comprising a mounting plate, a first roping component comprising a first roping roller, and a roping actuator operably connected to the first roping component to move the first roping component relative to the mounting plate between an upper position in which the first roping roller is above the mounting plate to a lower position in which the first roping roller is below the mounting plate.

In various embodiments, a method of wrapping a load on a pallet comprises: while a first roping component of a carriage is in an upper position above a mounting plate of the carriage, wrapping film having a first width around the load via relative rotation between the carriage and the load; moving the first roping component from the upper position to a lower position in which the first roping component is below the mounting plate to cause a roller of the first roping component to contact the film and manipulate the film into a rope form having a second width that is less than the first width; and afterwards, wrapping the film in the rope form around the load and the pallet via relative rotation between the carriage and the load to secure the load to the pallet.

DETAILED DESCRIPTION

Figure 1:
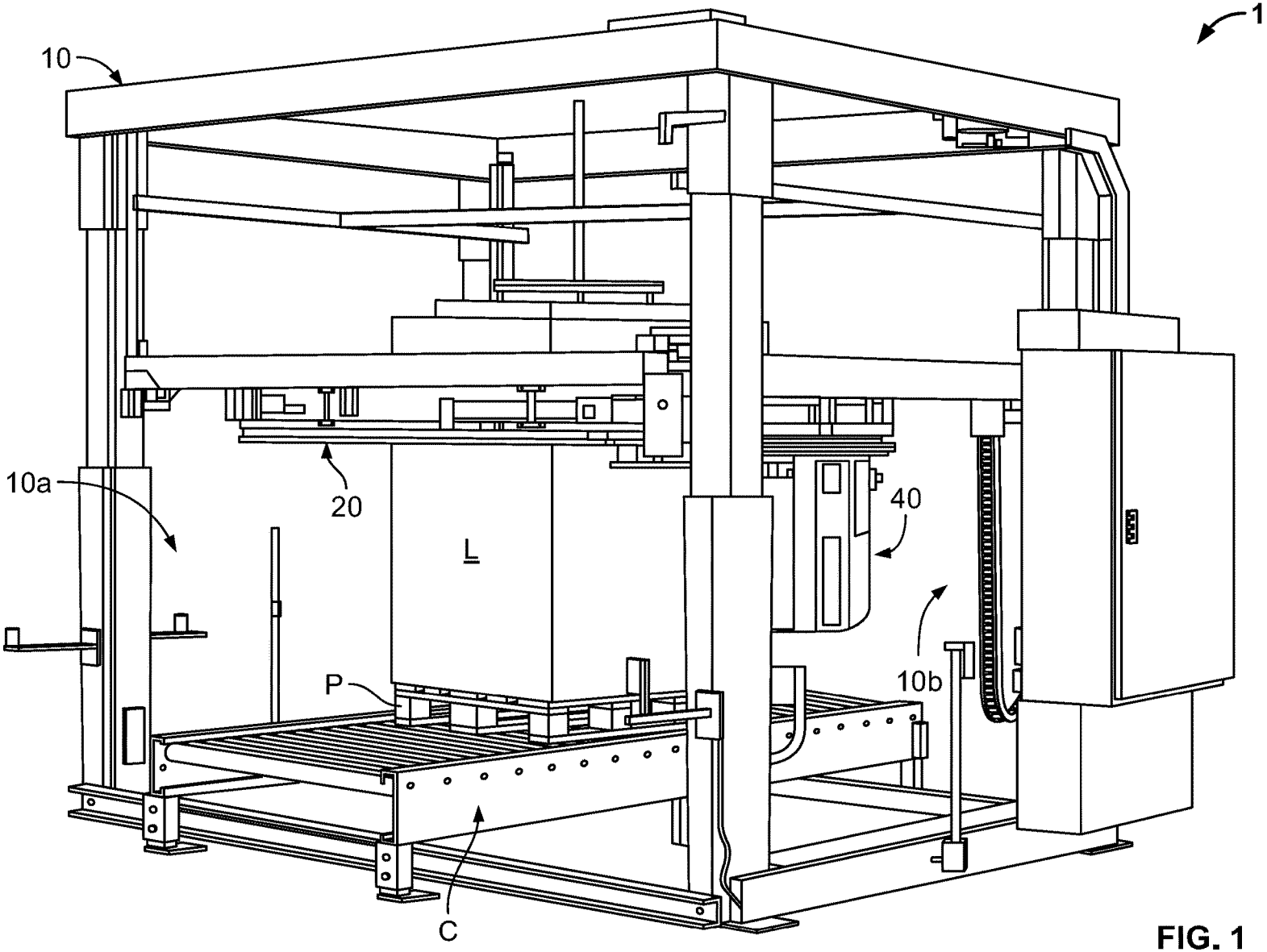
FIG. 1 is a perspective view of one example embodiment of a wrapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected and like mounting methods. This specification is intended to be taken as a whole and interpreted in accordance with the principles of the present disclosure and as understood by one of ordinary skill in the art.

Figure 2:
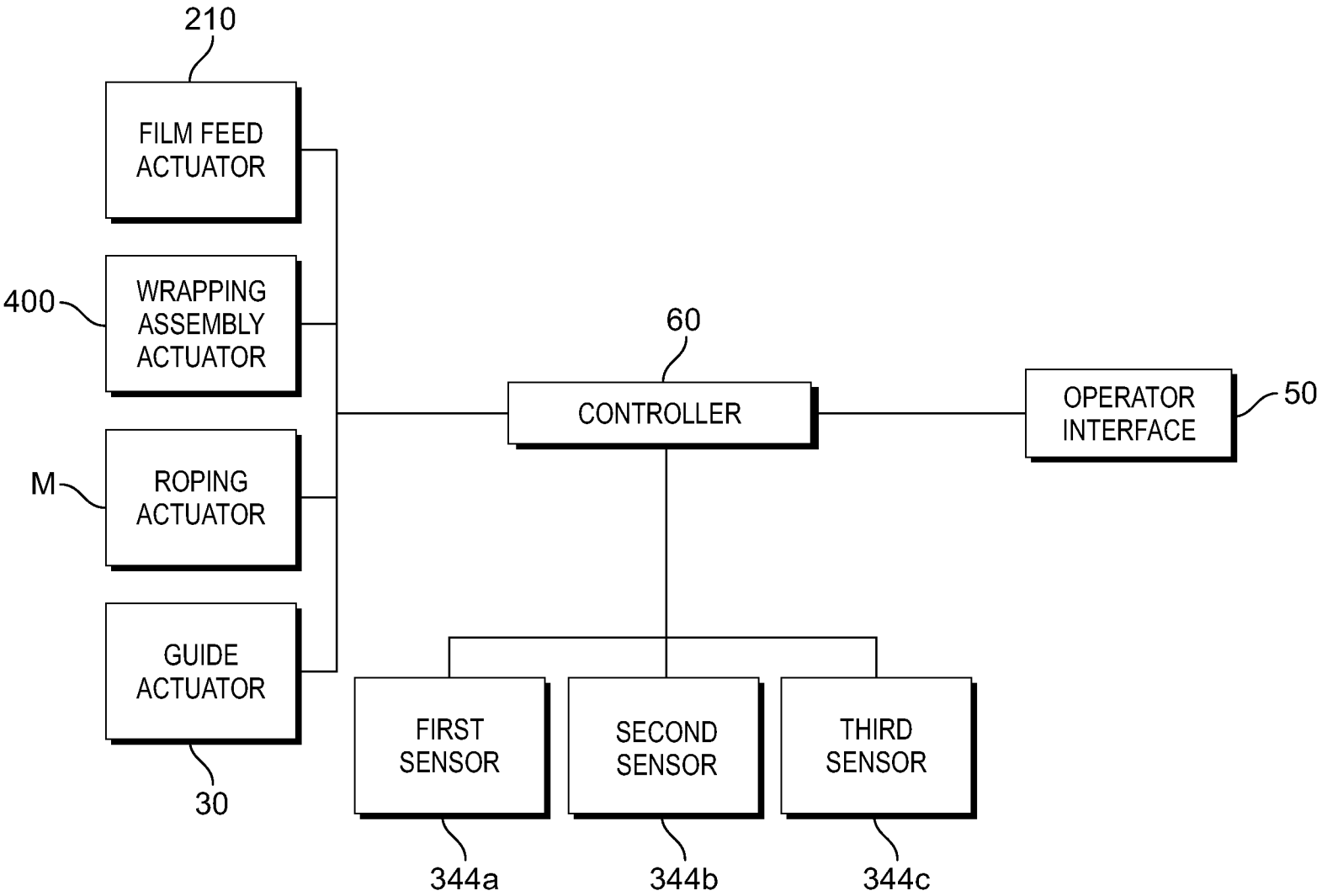
FIG. 2 is a block diagram showing certain components of the wrapping machine of FIG. 1.

Various embodiments of the present disclosure provide a wrapping machine that includes a roping carriage configured to manipulate a sheet of film into a reduced-width rope form to secure a load of palletized goods to a pallet. FIGS. 1 and 2 show one embodiment of the wrapping machine 1 of the present disclosure. The wrapping machine 1 includes a wrapping-machine frame 10, a circular guide 20, a guide actuator 30, a wrapping assembly 40, a cutting-and-fixing g device (not shown), an operator interface 50, and a controller 60.

The wrapping-machine frame 10 is formed from multiple tubular and/or solid members (not individually labeled) and configured to support the other components of the wrapping machine 1. The wrapping-machine frame 10 defines a wrapping area within its interior and has an in feed area 10*a* at which a palletized load (such as a load L on a pallet P) is conveyed (such as via a conveyor C) into the wrapping area for wrapping and an outfeed area 10*b* at which the palletized load is conveyed (such as via the conveyor C) from the wrapping area after wrapping. The illustrated wrapping-machine frame 10 is merely one example configuration, and any suitable configuration may be employed.

The circular guide 20 serves as the mount for the wrapping assembly 40 and is movably mounted to the wrapping-machine frame 10 (such as to one or more vertical members of the wrapping-machine frame 10) such that the circular guide 20 is vertically movable relative to the wrapping-machine frame 10 between an upper position and a lower position.

The guide actuator 30 is operably connected to the circular guide 20 to move the circular guide 20 relative to the wrapping-machine frame 10 between the upper and lower positions. In certain embodiments, the guide actuator 30 includes one or more motors operably connected to the circular guide 20 via one or more belt-and-pulley assemblies to move the circular guide 20 between the upper and lower positions. In other embodiments, the guide actuator 30 includes one or more pneumatic or hydraulic cylinders operably connected to the circular guide 20 to move the circular guide 20 between the upper and lower positions. There are merely examples, and the guide actuator 30 may include any suitable actuator configured to move the circular guide 20 between the upper and lower positions.

Figure 3:
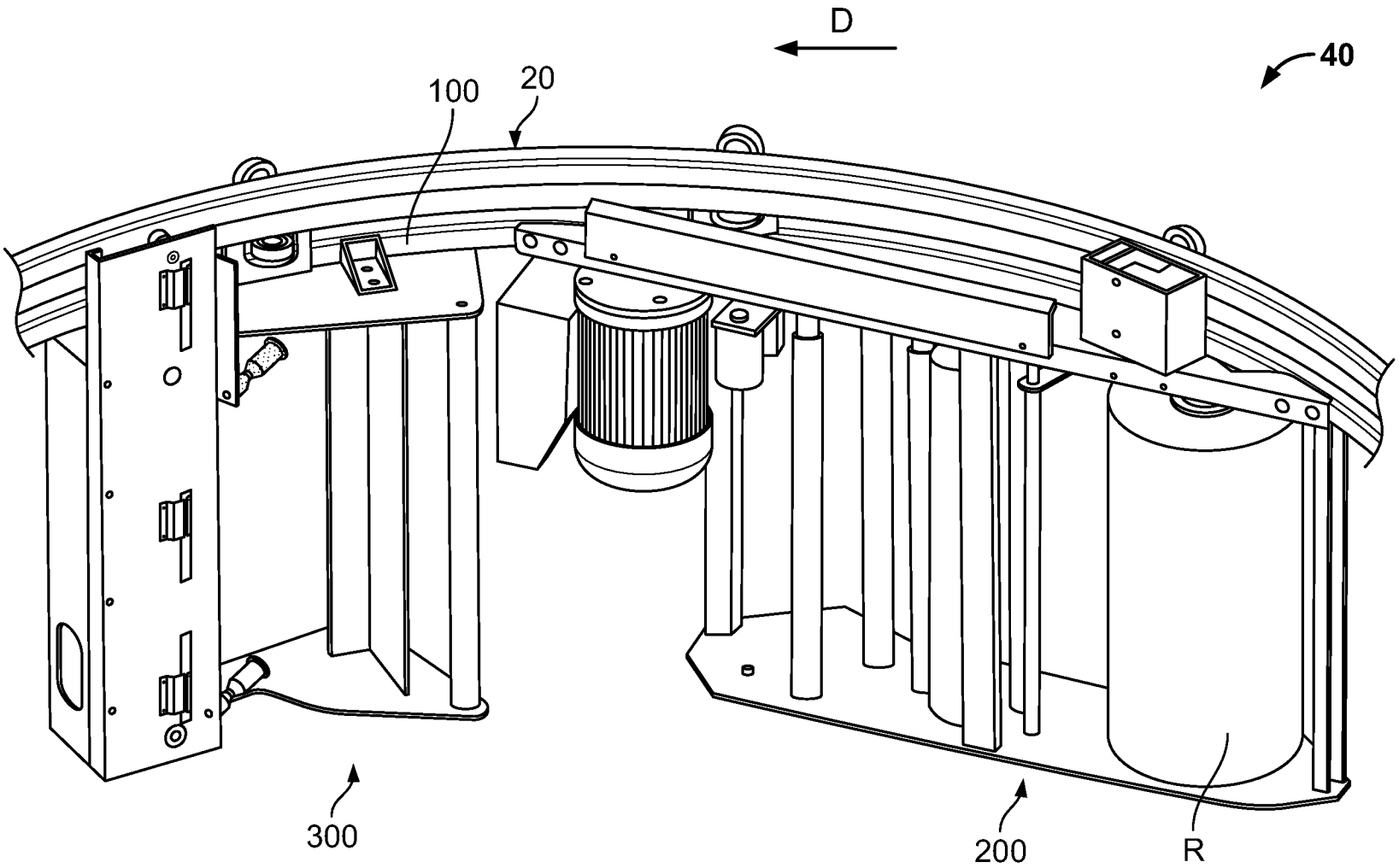
FIG. 3 is a fragmentary front perspective view of the circular guide and the wrapping assembly of the wrapping machine of FIG. 1.
Figure 4:
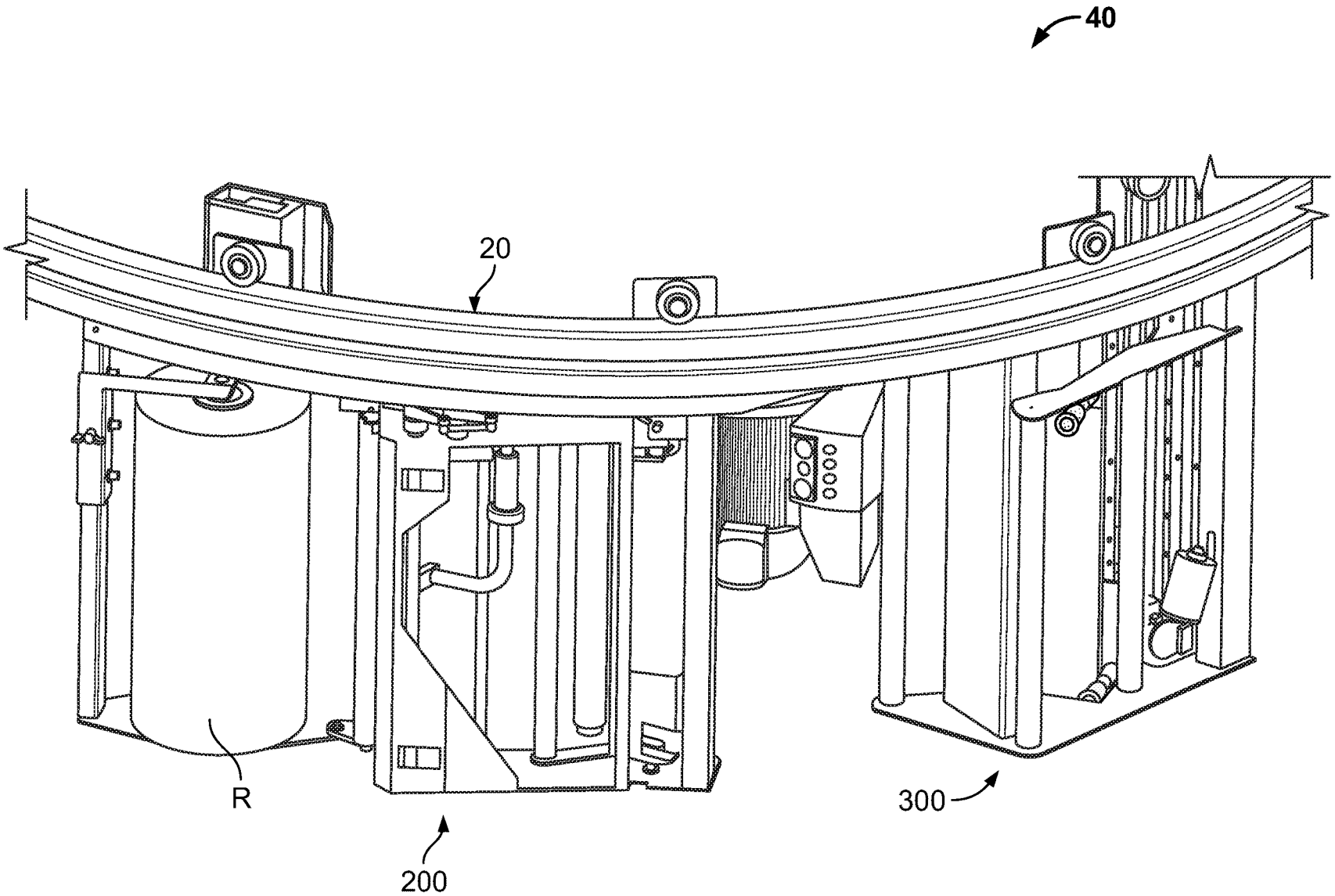
FIG. 4 is a fragmentary rear perspective view of the circular guide and the wrapping assembly of FIG. 3.

The wrapping assembly 40 is movably mounted to the circular guide 20 such that the wrapping assembly 40 is rotatable relative to the circular guide 20. As best shown in FIGS. 3 and 4, the wrapping assembly 40 includes a ring-shaped support 100, a film carriage 200, a roping carriage 300, and a wrapping-assembly actuator 400 (shown in FIG. 2).

The support 100 serves as the mount for the film and roping carriages 200 and 300 and is movably mounted to the circular guide 20 such that the support 100 (and the carriages and other components connected to the support 100) is rotatable relative to the circular guide 20. In this example embodiment, the support 100 is movably mounted to the circular guide 20 via multiple spaced-apart rollers (not labeled) that are connected to the support 100 and positioned on a track (not labeled) on the circular guide 20.

The film carriage 200 is fixedly connected to the support 100 to move with the support 100 (i.e., rotate relative to the circular guide 20 and move vertically relative to the wrapping-machine frame 10). The film carriage 200 is configured to rotatably support a roll R of film F (such as plastic stretch film) The film carriage 200 includes multiple rollers (not labeled) around which the film F is directed as the film F is drawn off the roll R during wrapping. The film carriage 200 also includes a film-feed actuator 210 operably connected to one or more of the rollers to control the feed rate of the film from the roll R. In certain embodiments, the film-feed actuator 210 is configured such that the film F is pre-stretched as it is drawn off the roll R and through the rollers. For instance, in certain embodiments the film-feed actuator is operably connected to two pre-stretch rollers and configured to rotate those rollers at different rotational speeds to cause the film to pre-stretch as it is drawn through the pre-stretch rollers as the support 100 rotates around the load L.

The roping carriage 300 is fixedly connected to the support 100 downstream of the film carriage 200. The film F is drawn off the roll R and directed through the rollers of the film and roping carriages in a direction D shown in FIG. 3. As used herein, "downstream" means in the direction D and "upstream" means in a direction opposite the direction D. As best shown in FIGS. 5-13, the roping carriage 300 includes a roping-carriage frame 310; first, second, and third spaced-apart idler rollers 322, 324, and 326; a sensing assembly 340; and a roping assembly 350.

Figure 5:
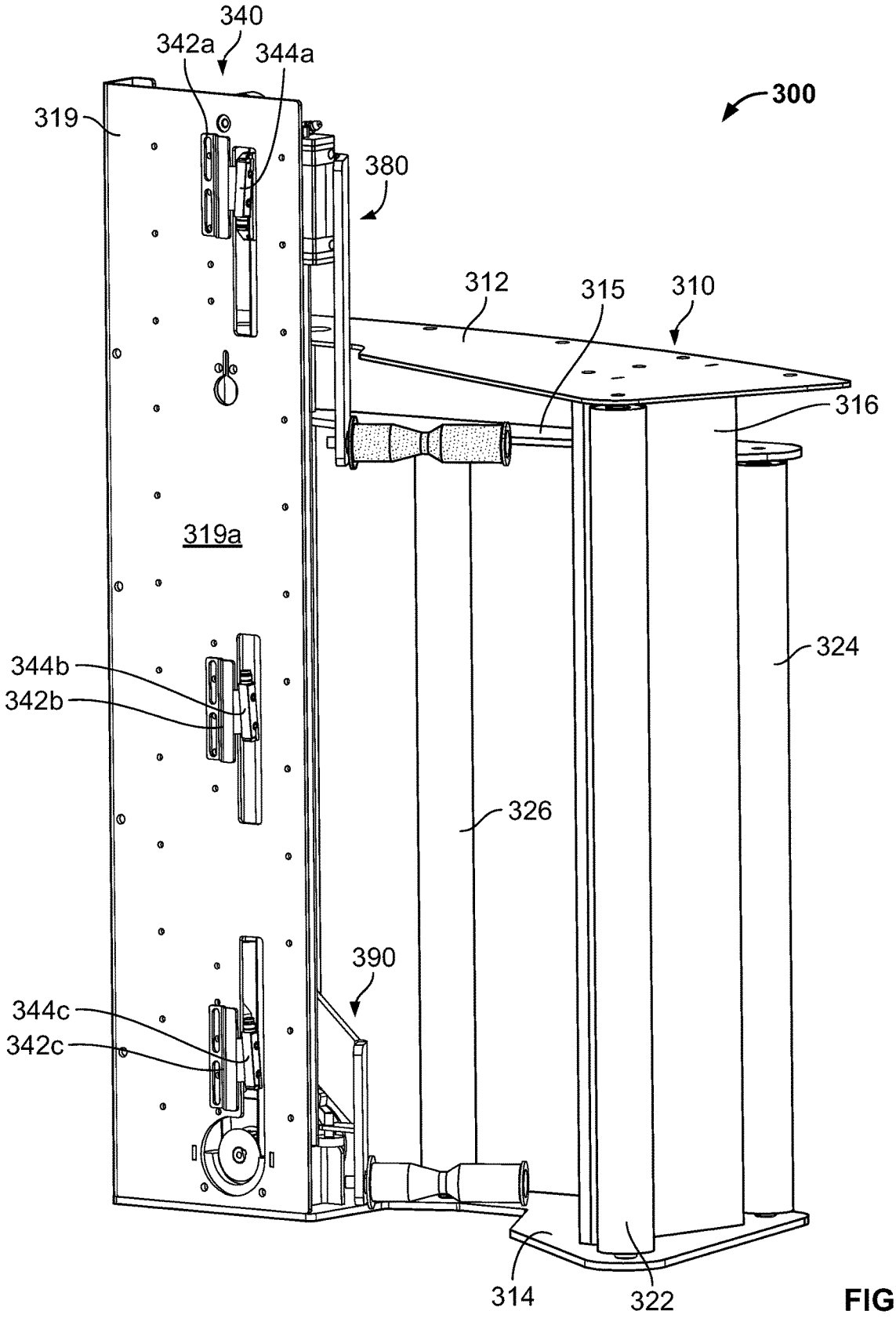
FIG. 5 is a front perspective view of the roping carriage of the wrapping assembly of FIG. 4.
Figure 6:
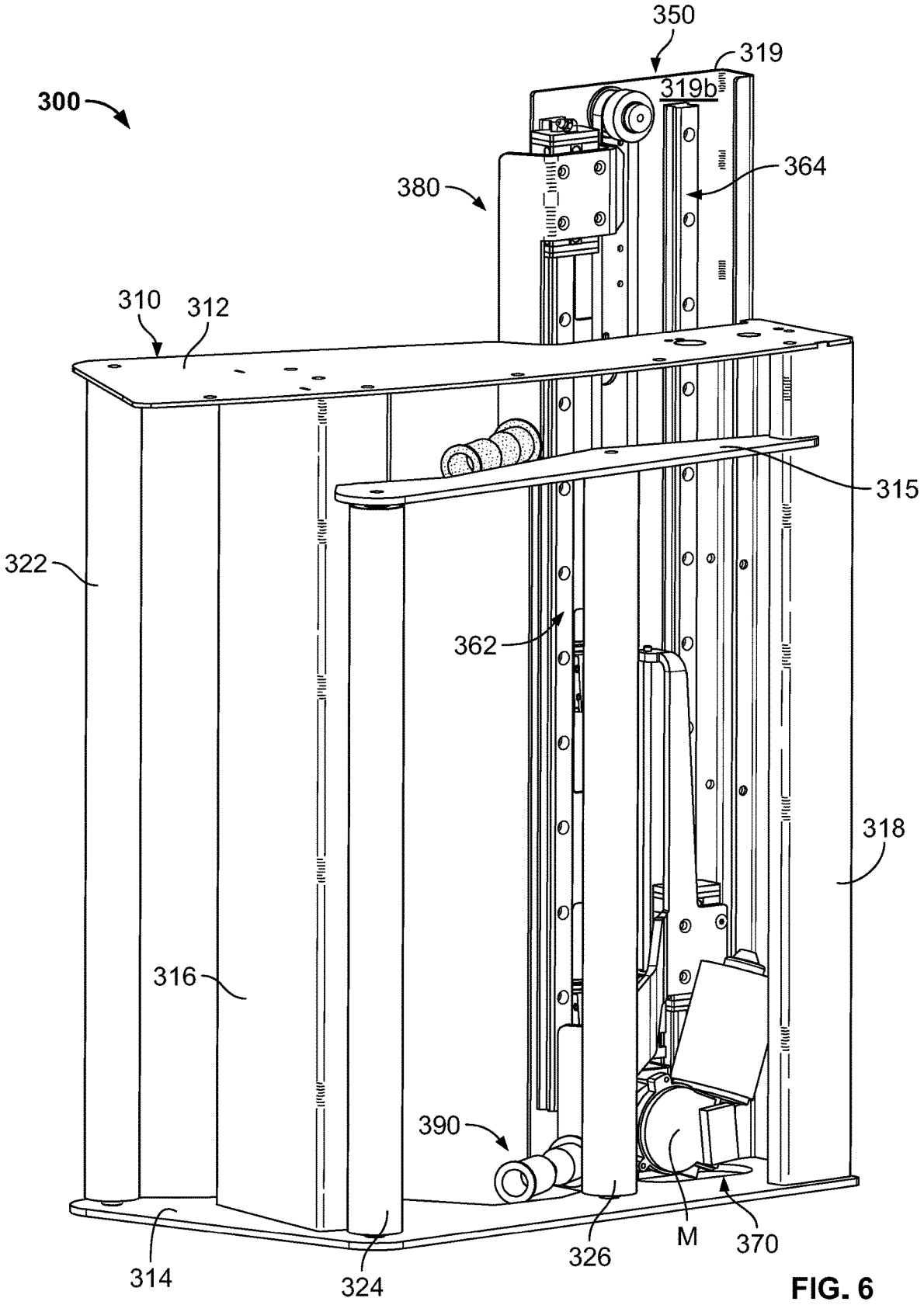
FIG. 6 is a rear perspective view of the roping carriage of FIG. 5.

The roping-carriage frame 310 serves as the mount for first, second, and third idler rollers 322, 324, and 326; the sensing assembly 340; and the roping assembly 350. As best shown in FIGS. 5 and 6, the roping-carriage frame 310 includes a first mounting plate 312, a second mounting plate 314, a third mounting plate 315, a first support 316, a second support 318, and a roping-assembly-mounting plate 319. The first and second mounting plates 312 and 314 are parallel to one another and spaced apart vertically. The first and second supports 316 and 318 are connected to and extend transversely between the first and second mounting plates 312 and 314. The third mounting plate 315 is connected to and extends transversely from the second support 318 such that the third mounting plate 315 is parallel to and spaced vertically from the first and second mounting plates 312 and 314. The vertical distance between the third mounting plate 315 and the second mounting plate 314 is less than the vertical distance between the first mounting plate 312 and the second mounting plate 314. The roping-assembly-mounting plate 319 is connected to and extends transversely from the second mounting plate 314 such that the free end (not labeled) of the roping-assembly-mounting plate 319 is above the first mounting plate 312. The roping-assembly-mounting plate 319 is also connected to the second support 318. The roping-assembly-mounting plate 319 has an outer surface 319*a* and an inner surface 319*b*.

The idler rollers 322, 324, and 326 are mounted to the roping-carriage frame 310, freely rotatable relative to the roping-carriage frame 310, and configured to direct the film F drawn off the roll R from the film carriage 200 to the roping components 380 and 390 of the roping assembly 350. As best shown in FIGS. 5 and 6, the first idler roller 322 extends transversely between and is rotatably mounted to the first and second mounting plates 312 and 314 (such as via a spindle and bearings) such that the first idler roller 322 is rotatable relative to the first and second mounting plates 312 and 314. The second and third idler rollers 324 and 326 extend transversely between and are rotatably mounted to the first and third mounting plates 312 and 315 (such as via respective spindles and bearings) such that the second and third idler rollers 324 and 326 are rotatable relative to the first and third mounting plates 312 and 315.

The sensing assembly 340 is mounted to the roping-assembly-mounting plate 319 and configured to sense the positions of the roping components 380 and 390 of the roping assembly 350 and to generate and send signals representing the sensed positions to the controller 60. As best shown in FIG. 5, the sensing assembly 340 includes first, second, and third sensor-mounting brackets 342*a*, 342*b*, and 342*c* mounted (such as via suitable fasteners, not shown) to the outer surface 319*a* of the roping-assembly-mounting plate 319 adjacent respective openings defined in the roping-assembly-mounting plate 319 near its top, middle, and bottom (not labeled). First, second, and third sensors 344*a*, 344*b*, and 344*c* are respectively mounted to the first, second, and third sensor-mounting brackets 342*a*, 342*b*, and 342*c* such that the sensors are positioned within the respective openings defined in the roping-assembly-mounting plate 319. In this example embodiment, the sensors are inductive proximity sensors that are configured to detect metal. The sensors 344*a*, 344*b*, and 344*c* are communicatively connected to the controller 60 such that the sensors can send signals to the controller responsive to detecting metal. As explained below, this enables the sensors to sense the positions of the roping components 380 and 390 of the roping assembly 350. The sensors may be any suitable sensors that generate signals that enable the controller to determine the positions of the first and second roping components. In certain embodiments, the roping actuator includes an encoder, the output of which the controller may use to determine the locations of the roping components.

The roping assembly 350 is mounted to the roping-assembly-mounting plate 319 and configured to contact and manipulate the film F into a rope form that has a width $W_2$ that is substantially smaller than a full (unmodified) width $W_1$ of the film F As best shown in FIGS. 6-13, the roping assembly 350 includes a first rail 362, a second rail 364, a drive assembly 370, a first roping component 380, and a second roping component 390.

Figure 12:
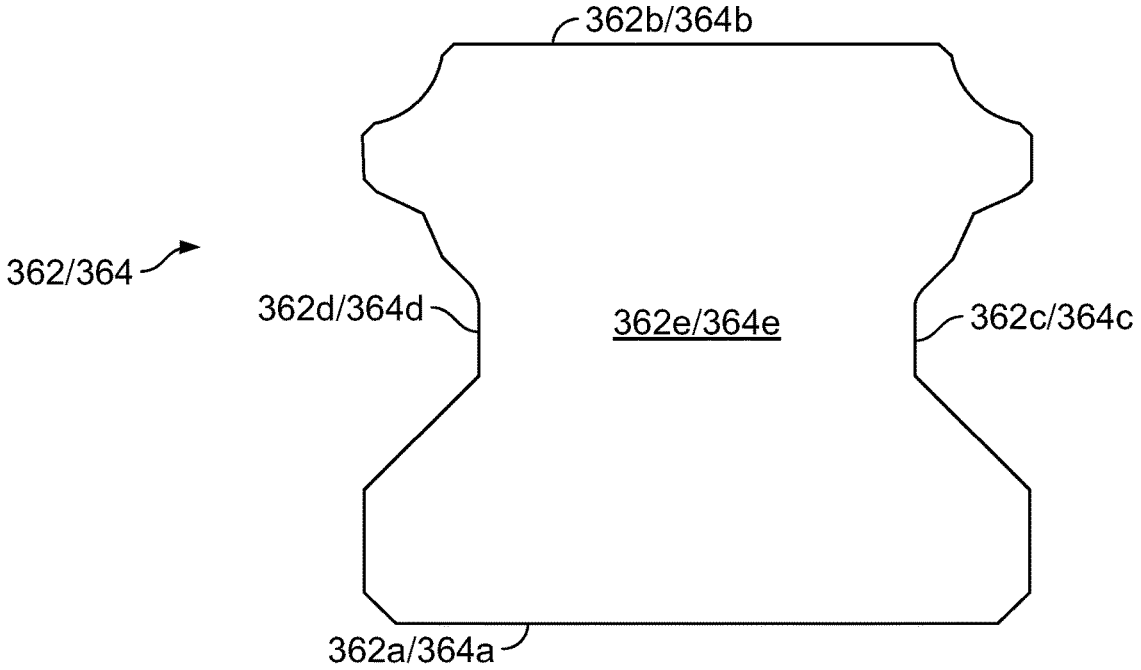
FIG. 12 is a top plan view of one of the rails of the roping assembly of FIG. 7.
Figure 13:
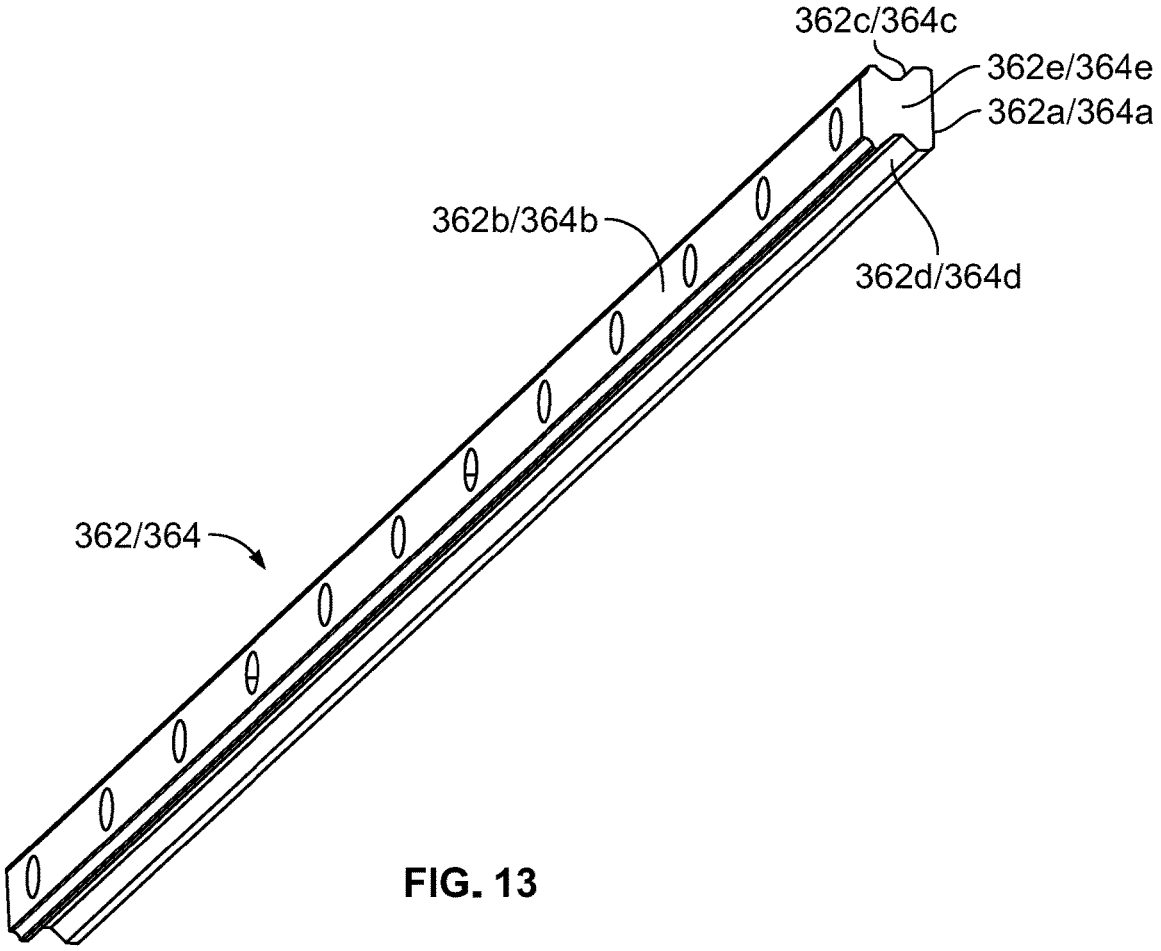
FIG. 13 is a perspective view of the rail of FIG. 12.

The first and second rails 362 and 364 are spaced-apart, mounted to the roping-assembly-mounting plate 319, and serve as mounts for the first and second roping components 380 and 390. As best shown in FIGS. 12 and 13, the first rail 362 includes opposing planar front and back surfaces 362*a* and 362*b*, opposing contoured side surfaces 362*c* and 362*d* extending between the front and back surfaces 362*a* and 362*b*, and opposing planar first and second end surfaces 362*e* and 362*f* (second end surface 362*f* is not shown in the Figures but provided an element number in the Detailed Description for clarity). The second rail 364 includes opposing planar front and back surfaces 364*a* and 364*b*, opposing contoured side surfaces 364*c* and 364*d* extending between the front and back surfaces 364*a* and 364*b*, and opposing planar first and second end surfaces 364*e* and 364*f* (second end surface 364*f* is not shown in the Figures but provided an element number in the Detailed Description for clarity).

As best shown in FIG. 6, the first and second rails 362 and 364 are mounted (such as via suitable fasteners, not shown) to the inner surface 319*b* of the roping-assembly-mounting plate 319 so the respective front surfaces 362*a* and 364*a* of the first and second rails 362 and 364 abut the inner surface 319*b*. The first and second rails 362 and 364 are oriented generally parallel to one another and transverse (such as perpendicular) to the second mounting plate 314 of the roping-carriage frame 310.

Figure 7:
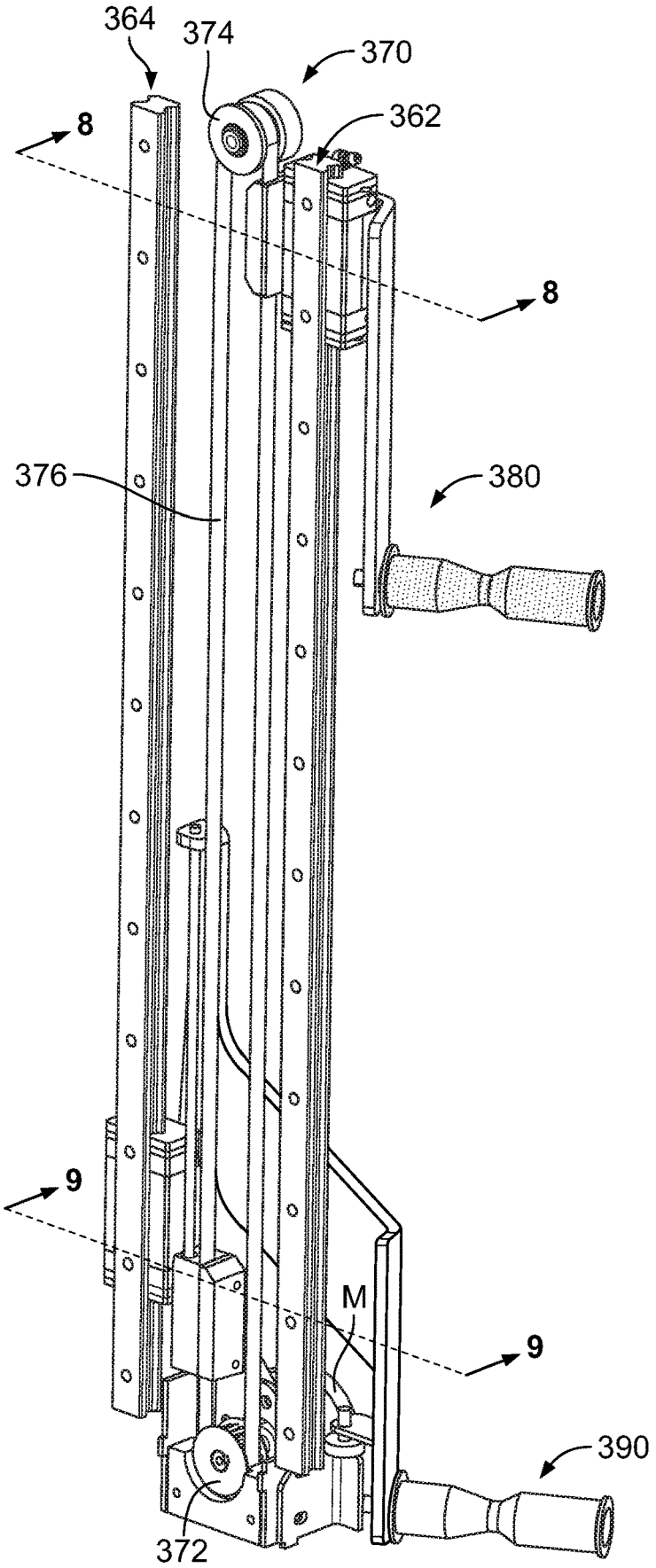
FIG. 7 is a front perspective view of the roping assembly of the roping carriage of FIG. 5.

The drive assembly 370 is mounted to the roping-carriage frame 310 and configured to move the first and second roping components 380 and 390. As best shown in FIG. 7, the drive assembly 370 includes a roping actuator M, a drive wheel 372, a driven wheel 374, and a flexible drive member 376.

In this example embodiment, the roping actuator M includes a suitable motor mounted to the first mounting plate 312 of the roping-carriage frame 310, communicatively connected to the controller 60 to receive signals from (and in certain embodiments send signals to) the controller 60, and electrically connected to a power source (not shown) of the wrapping machine 1 to power the motor. The roping actuator may include any other suitable actuator in other embodiments.

In this example embodiment, the drive wheel 372 and the driven wheel 374 are toothed pulleys and the flexible drive member 376 includes a toothed belt having teeth (not shown for clarity) sized and oriented to mesh with the teeth of the drive wheel 372 and the driven wheel 374. Generally, the roping actuator M is operably connected to the drive wheel 372 and the driven wheel 374 to drive the drive wheel 372 and the driven wheel 374 to cause the drive member 376 to move clockwise or counter-clockwise to move the roping components 380 and 390. Specifically, the drive wheel 372 is fixedly mounted to an output shaft (not labeled) of the roping actuator M (such as via a keyed or splined connection) so the drive wheel 372 rotates with the output shaft. The driven wheel 372 is rotatably mounted to the roping-assembly-mounting plate 319 (such as via a suitable spindle and bearings) above the driven wheel 372. The drive member 376 is positioned around and operably connects the driven wheel 372 and the drive wheel 374. In operation, actuation of the roping actuator M causes its output shaft to rotate, which in turn causes the drive wheel 372 (fixedly connected to the output shaft) to rotate, which in turn causes the flexible drive member 376 (the teeth of which mesh with the teeth of the drive wheel 372) to move, which in turn causes the driven wheel 374 (the teeth of which mesh with the teeth of the flexible drive member 376) to rotate. In other embodiments, the drive wheel and driven wheel are gears and the drive member is a chain. In other embodiments, neither the drive wheel, nor the driven wheel, nor the drive member includes meshing teeth.

Figure 10:
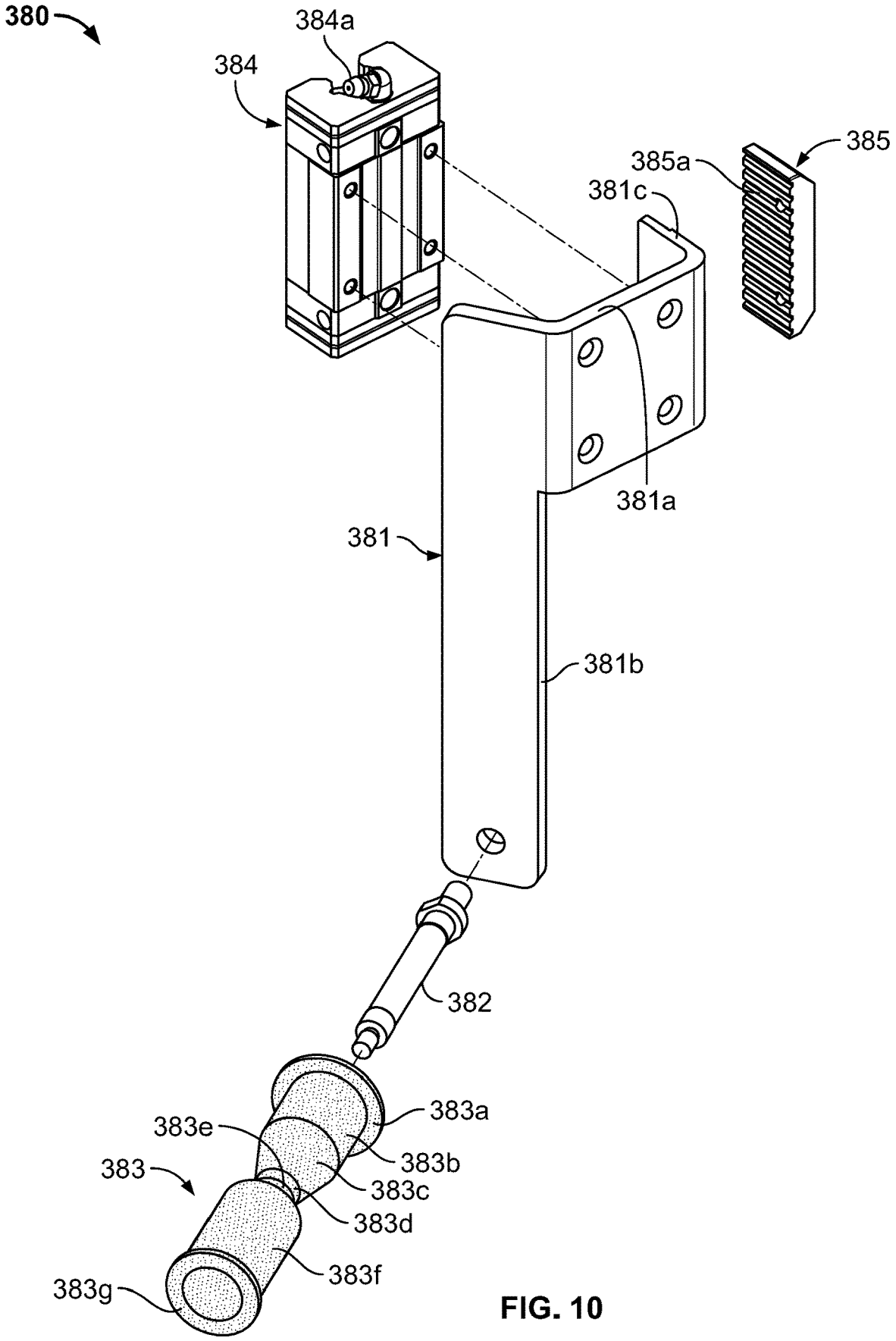
FIG. 10 is a partially exploded perspective view of the first roping component of the roping assembly of FIG. 7.

The first roping component 380 is mounted to the flexible drive member 376 and, along with the second roping component 390, is movable to contact and manipulate the film F into a rope form that has the width $W_2$ that is substantially smaller than the full (unmodified) width $W_1$ of the film F. As best shown in FIG. 10, the first roping component 380 includes a mounting bracket 381, a spindle 382, a roller 383, a rail connector 384, and a drive-member clamp 385.

The mounting bracket 381 serves as the mount for the spindle 382, the roller 383, the rail connector 384, and the drive-member clamp 385. The mounting bracket 381 includes a body having a rail-connector-mounting portion 381*a*, a spindle-mounting portion 381*b* connected to one side of (and here integrally formed with) the rail-connector-mounting portion 381*a*, and a drive-member-clamp-mounting portion 381*c* connected to the opposite side of (and here integrally formed with) the rail-connector-mounting portion 381*a*. In this example embodiment, the mounting bracket 381 is a one-piece component formed from (or that otherwise includes a suitable amount of) metal such that the first, second, and third sensors 344*a*, 344*b*, and 344*c* can detect the presence of the mounting bracket 381, as described below.

The spindle 382 serves as the mount for the roller 383, and is fixedly (or rotatably in other embodiments) mounted to a free end of the spindle-mounting portion 381*b* of the mounting bracket 381.

The roller 383 is rotatably (or fixedly in other embodiments) mounted to the spindle 382, such as via suitable bearings (not shown). After assembly, the roller 383 is rotatable relative to the mounting bracket 381. The roller 383 includes an inner flange 383*a*, an inner cylindrical portion 383*b*, an inner conical portion 383*c*, a central cylindrical portion 383*d*, an outer conical portion 383*e*, an outer cylindrical portion 383*f*, and an outer flange 383*g*. The inner and outer conical portions 383*c* and 383*e* taper radially inwardly toward each other so the central cylindrical portion 383*d* has a smaller diameter than that of the inner and outer cylindrical portions 383*b* and 383*f*. The diameters of the inner and outer flanges 383*a* and 383*g* are larger than the diameters of the inner and outer cylindrical portions 383*b* and 383*f*. The tapering at the center of the roller 383 helps maintain the film F when in rope form at the center of the roller 383.

The rail connector 384 is configured to slidably mount the first roping component 380 to the first rail 362, and includes a body in the form of a rectangular parallelepiped that defines a rail receiving channel 384*a* therethrough. The rail-receiving channel 384*a* is defined by surfaces that correspond to the back surface 362*b* and the contoured side surfaces 362*c* and 362*d* of the first rail 362 so the rail-receiving channel 384*a* is sized and shaped to receive the first rail 362, as described below. The rail connector 384 is connected (such as via suitable fasteners, not shown) to the rail-connector-mounting portion 381*a* of the mounting bracket 381.

The drive-member clamp 385 is configured to connect the first roping component 380 to the drive member 376, and includes a body having a toothed drive-member-engaging surface 385*a*.

The first roping component 380 is slidably mounted to the first rail 362 via receipt of part of the first rail 362 in the rail-receiving channel 384*a* of the rail connector 384 of the first roping component 380. The shapes of the side surfaces 362*c* and 362*d* of the first rail (and the shapes of the corresponding surfaces of the rail connector 384 that define the rail-receiving channel 384*a*) prevent lateral movement of the first roping component 380 relative to the first rail 362 (i.e., prevent movement in a plane perpendicular to the direction in which the first roping component 380 slides along the first rail 362).

Figure 8:
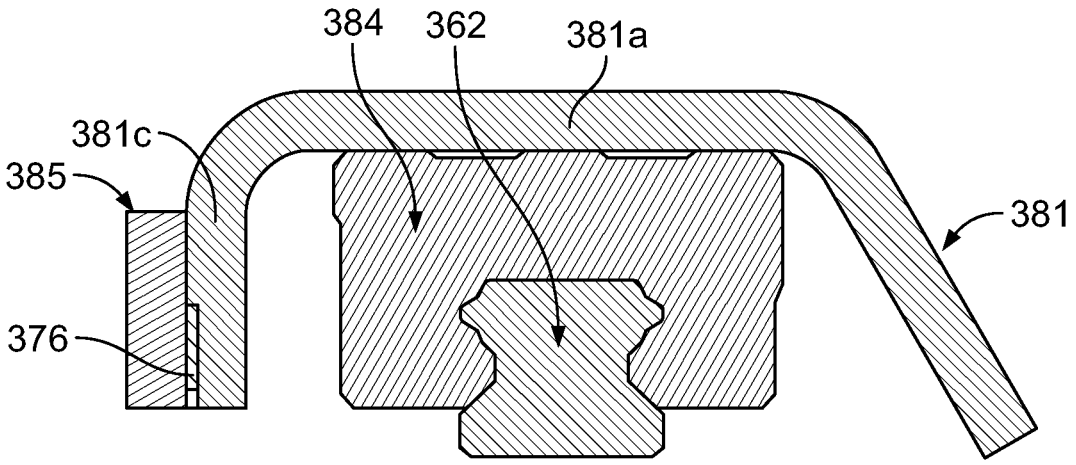
FIG. 8 is a cross-sectional view of part of the roping assembly of FIG. 7 taken substantially along line 8-8 of FIG. 7.

As best shown in FIG. 8, the first roping component 380 is fixedly connected to the flexible drive member 376 to move therewith by sandwiching part of the flexible drive member 376 between the drive member-engaging surface 385*a* of the drive-member clamp 385 and the drive-member-clamp-mounting portion 381*c* of the mounting bracket 381. That is, the drive-member clamp 385 is fixedly connected (such as via suitable fasteners) to the drive-member-clamp-mounting portion 381*c* to apply sufficient compressive force to the part of the drive member 376 so the drive member 376 does not move relative to the first roping component 380 and such that the first roping component 380 moves with the drive member 376.

Figure 11:
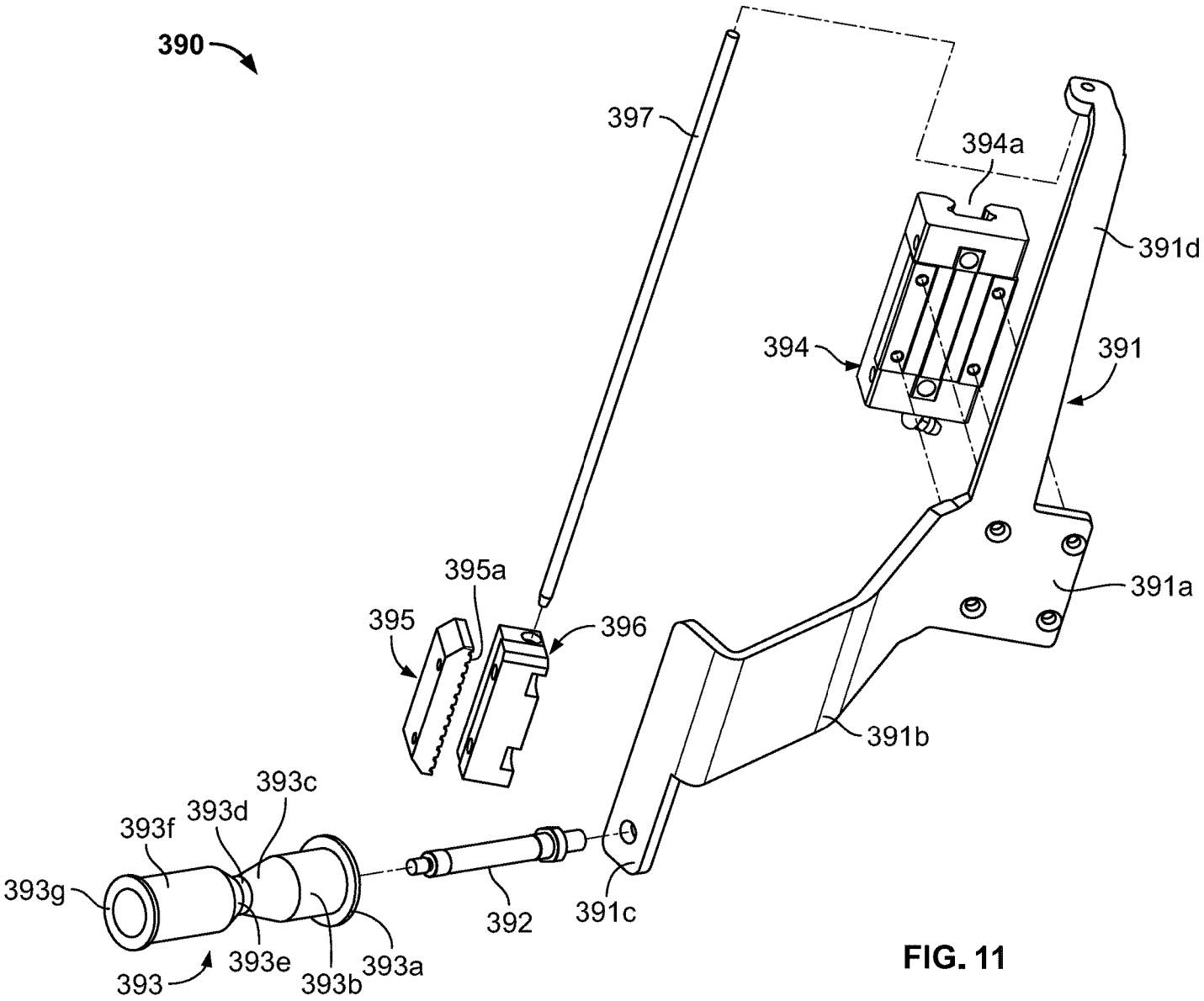
FIG. 11 is a partially exploded perspective view of the second roping component of the roping assembly of FIG. 7.

The second roping component 390 is mounted to the flexible drive member 376 and, along with the first roping component 380, is movable to contact and manipulate the film F into a rope form that has the width $W_2$ that is substantially smaller than the full (unmodified) width $W_1$ of the film F As best shown in FIG. 11, the second roping component 390 includes a mounting bracket 391, a spindle 392, a roller 393, a rail connector 394, a drive-member clamp 395, a drive-member-clamp mount 396, and a rod 397.

The mounting bracket 391 serves as the mount for the spindle 392, the roller 393, the rail connector 394, and the rod 397. The mounting bracket 391 includes a body having a rail-connector-mounting portion 391*a*, a connecting portion 391*b* connected to one side of (and here integrally formed with) the rail-connector-mounting portion 391*a*, a spindle-mounting portion 391*c* connected to (and here integrally formed with) the connecting portion 391*b* opposite the rail-connector-mounting portion 391*a*, and a rod-mounting portion 391*d* connected to (and here integrally formed with) the rail-connector-mounting portion 391*a*. In this example embodiment, the mounting bracket 391 is a one-piece component formed from (or that otherwise includes a suitable amount of) metal such that the first, second, and third sensors 344*a*, 344*b*, and 344*c* can detect the presence of the mounting bracket 391, as described below.

The spindle 392 serves as the mount for the roller 393, and is fixedly (or rotatably in other embodiments) mounted to a free end of the spindle-mounting portion 391*c* of the mounting bracket 391.

The roller 393 is rotatably (or fixedly in other embodiments) mounted to the spindle 392, such as via suitable bearings (not shown). After assembly, the roller 393 is rotatable relative to the mounting bracket 391. The roller 393 includes an inner flange 393*a*, an inner cylindrical portion 393*b*, an inner conical portion 393*c*, a central cylindrical portion 393*d*, an outer conical portion 393*e*, an outer cylindrical portion 393*f*, and an outer flange 393*g*. The inner and outer conical portions 393*c* and 393*e* taper radially inwardly toward each other so the central cylindrical portion 393*d* has a smaller diameter than that of the inner and outer cylindrical portions 393*b* and 393*f*. The diameters of the inner and outer flanges 393*a* and 393*g* are larger than the diameters of the inner and outer cylindrical portions 393*b* and 393*f*. The tapering at the center of the roller 393 helps maintain the film F when in rope form at the center of the roller 393.

The rail connector 394 is configured to slidably mount the second roping component 390 to the second rail 364, and includes a body in the form of a rectangular parallelepiped that defines a rail receiving channel 394*a* therethrough. The rail-receiving channel 394*a* is defined by surfaces that correspond to the back surface 364*b* and the contoured side surfaces 364*c* and 364*d* of the second rail 364 so the rail-receiving channel 394*a* is sized and shaped to receive the second rail 364, as described below. The rail connector 394 is connected (such as via suitable fasteners, not shown) to the rail-connector-mounting portion 391*a* of the mounting bracket 391.

The rod 397 is a suitably shaped and suitably rigid component configured to connect the drive-member-clamp mount 396 to the mounting bracket 391, and is fixedly connected at one end to the rod-mounting portion 391*d* of the mounting bracket 391.

The drive-member-clamp mount 396 is fixedly connected to the other end of the rod 397. The drive-member clamp 395 is configured to connect the second roping component 390 to the drive member 376, and includes a body having a toothed drive-member-engaging surface 395*a*.

The second roping component 390 is slidably mounted to the second rail 364 via receipt of part of the second rail 364 in the rail-receiving channel 394*a* of the rail connector 394 of the second roping component 390. The shapes of the side surfaces 364*c* and 364*d* of the first rail (and the shapes of the corresponding surfaces of the rail connector 394 that define the rail-receiving channel 394*a*) prevent lateral movement of the second roping component 390 relative to the second rail 364 (i.e., prevent movement in a plane perpendicular to the direction in which the second roping component 390 slides along the second rail 364).

Figure 9:
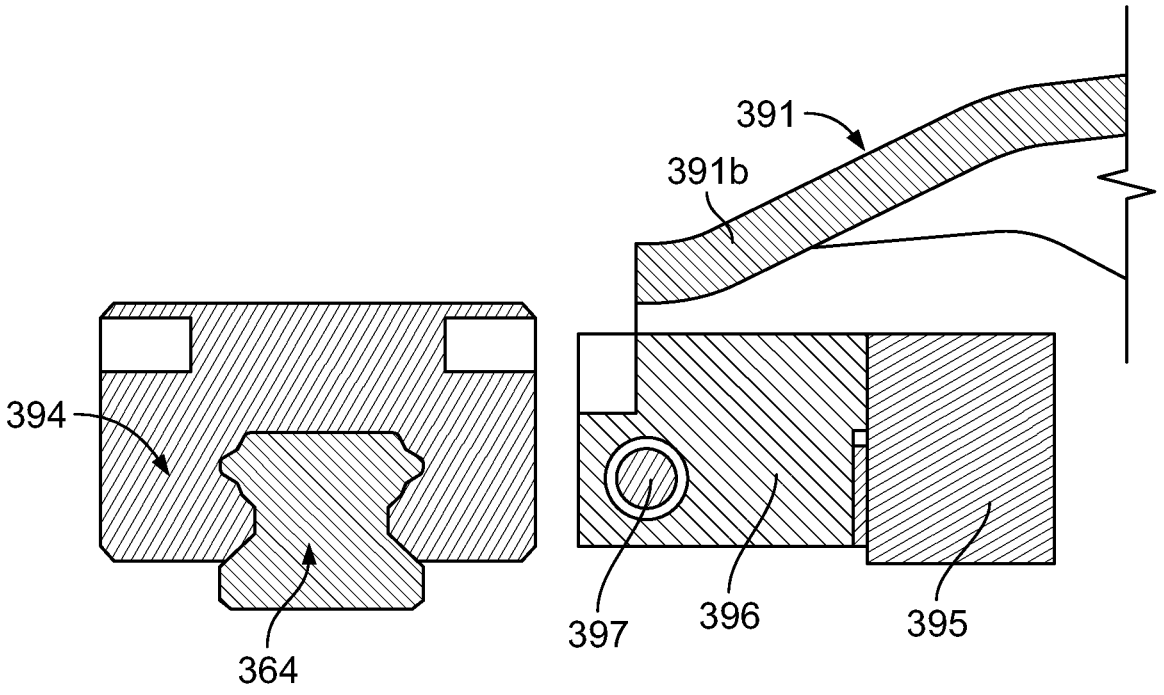
FIG. 9 is a cross-sectional view of another part of the roping assembly of FIG. 7 taken substantially along line 9-9 of FIG. 7.

As best shown in FIG. 9, the second roping component 390 is fixedly connected to the flexible drive member 376 to move therewith by sandwiching part of the flexible drive member 376 between the drive member-engaging surface 395*a* of the drive-member clamp 395 and the drive-member-clamp mount 396. That is, the drive-member clamp 395 is fixedly connected (such as via suitable fasteners) to the drive-member-clamp mount 396 to apply sufficient compressive force to the part of the drive member 376 so the drive member 376 does not move relative to the second roping component 390 and such that the second roping component 390 moves with the drive member 376.

As best shown in FIGS. 6 and 7, the first roping component 380 is connected to a portion of the drive member 376 that is between the driven wheel 372 and the drive wheel 374 and that is closer to the first rail 362 than the second rail 364. The second roping component 390 is connected to a portion of the drive member 376 that is between the driven wheel 372 and the drive wheel 374 and that is closer to the second rail 364 than the first rail 362. The first and second roping components 380 and 390 are connected to the drive member 376 such that they are movable relative to one another (via the roping actuator M, described below) between a full-width configuration and a roping configuration. Put differently, the roping actuator M is operably connected to the first and second roping components 380 and 390 to move the first and second roping components 380 and 390 between the full-width and roping configurations.

Figure 14:
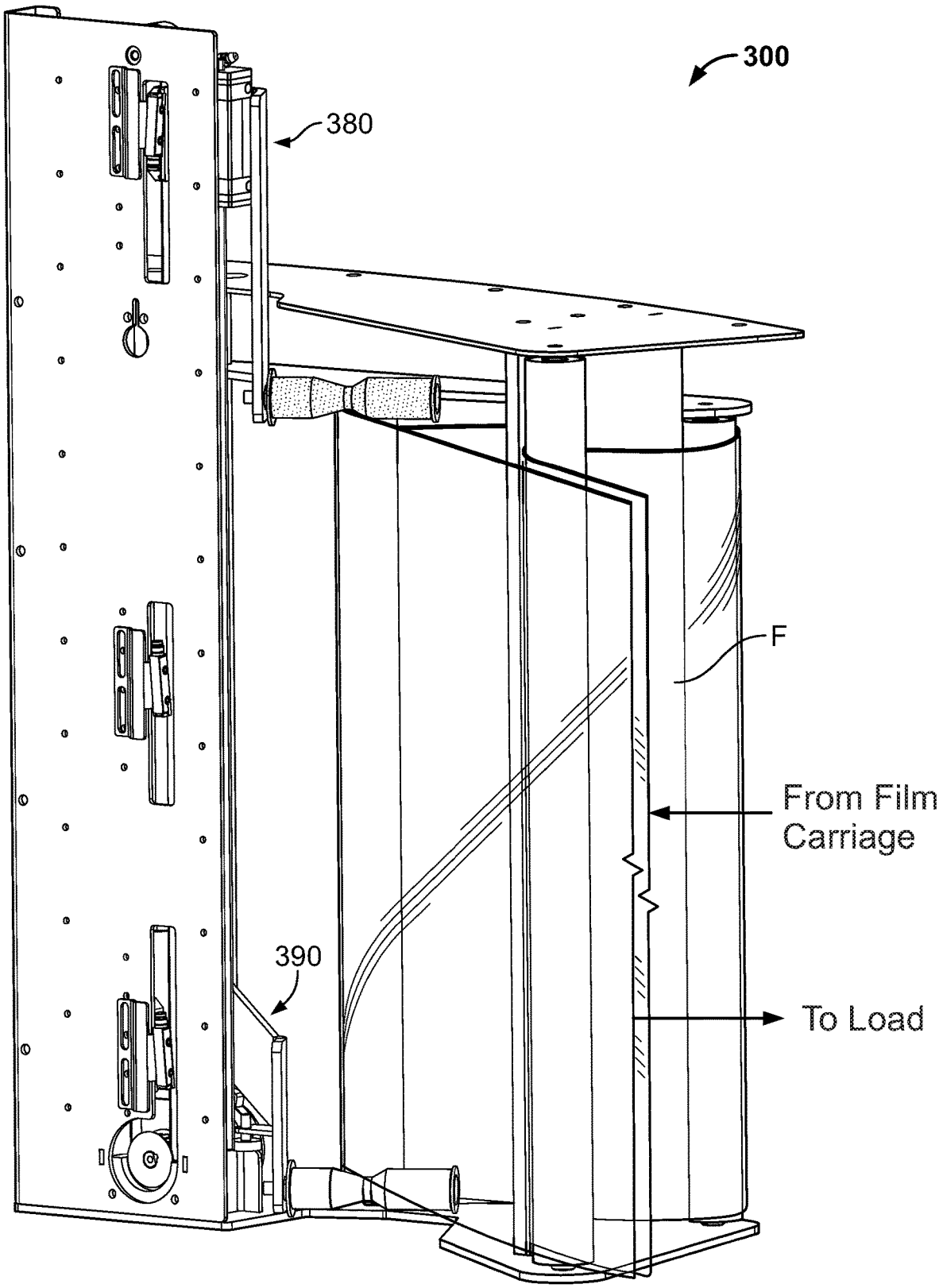
FIG. 14 is a perspective view of the roping carriage of FIG. 5 with the film threaded through the idler rollers and the first and second roping components, which are in the full-width configuration and do not manipulate the film so the film exits the roping carriage at full width.
Figure 15:
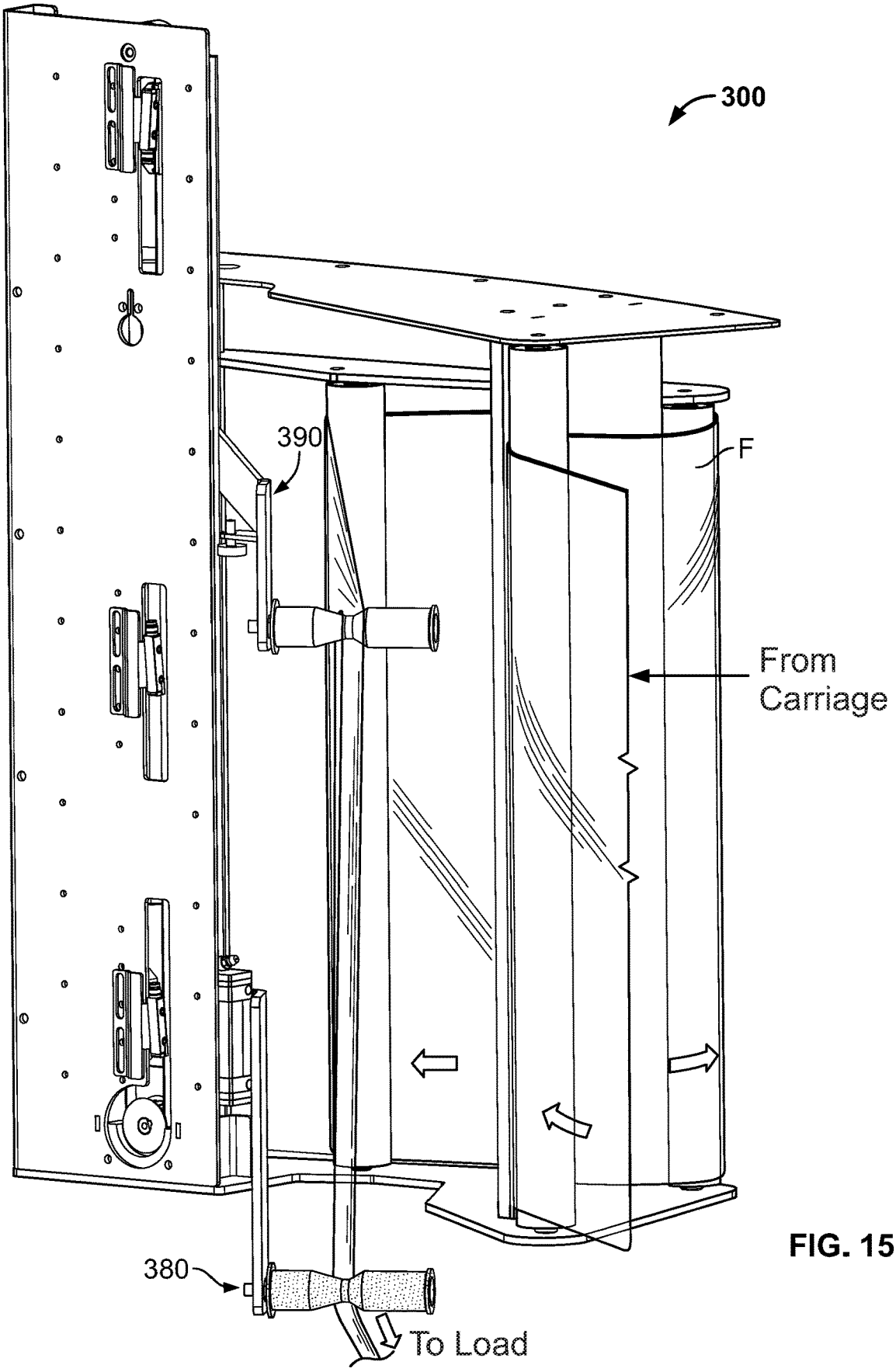
FIG. 15 is a perspective view of the roping carriage of FIG. 5 with the film threaded through the idler rollers and the first and second roping components, which are in the roping configuration and manipulate the film so the film takes a reduced-width rope form when exiting the roping carriage.

FIG. 14 shows the first and second roping components 380 and 390 in the full-width configuration. In this configuration, the first roping component 380 is at an upper (or first) position in which the drive-member clamp 385 is near the driven wheel 374 and the first sensor 344*a*, and the second roping component 390 is at a lower (or second) position in which the drive-member clamp 395 is near the drive wheel 372 and the third sensor 344*b*. To move the first and second roping components 380 and 390 into the roping configuration, the controller 60 actuates the roping actuator M to cause the drive wheel 372 to rotate clockwise, which drives the drive member 376 in a clockwise direction. This simultaneously causes the first roping component 380 (which is fixedly connected to the drive member 376) to move downward toward a lower (or second) position and the second roping component 390 (which is fixedly connected to the drive member 376) to move upward toward an upper (or second) position. FIG. 15 shows the first and second roping components 380 and 390 in the roping configuration. In this configuration, the first roping component 390 is at the lower (or second) position in which the drive-member clamp 385 is near the drive wheel 372 and the third sensor 344*c*, and the second roping component 390 is at the upper (or second) position in which the drive-member clamp 395 is near the driven wheel 394 and the first sensor 344*a*. In this embodiment, when the first roping component 380 is at the lower position, the roller 383 is positioned lower (further from the mounting bracket 314) than the roller 393 when the second roping component 390 is at the lower position.

In other embodiments, the film and roping carriages are combined into a single carriage rather than two separate carriages mounted to the support 100.

The cutting-and-fixing device (not shown) is supported by the wrapping-machine frame 10 and configured to, after the load L has been wrapped, cut the film F from the roll R to form a trailing end of the film F and to connect the trailing end to the wrapped load L to complete the wrapping process. Cutting the film F also creates a leading end of the film F on the roll R. The cutting-and-fixing device is also configured to hold the leading end after cutting the film F and to connect the leading end to the next load as it is being wrapped. The cutting-and-fixing device may be any suitable conventional cutting-and-fixing device known in the art.

The operator interface 50 is configured to receive inputs from an operator and, in certain embodiments, to output information to the operator. The operator interface includes one or more input devices configured to receive inputs from the operator. In various embodiments, the one or more input devices include one or more buttons (such as hard or soft keys), one or more switches, and/or a touch panel. In various embodiments, the operator interface 50 includes a display device configured to display information to the operator, such as information about the palletized load, the status of the wrapping operation, or the parameters of the wrapping machine 1. The operator interface may include other output devices instead of or in addition to the display device, such as one or more speakers and/or one or more lights. In certain embodiments, the operator interface 50 is formed as part of the wrapping machine 1 and is, for instance, mounted to the wrapping-machine frame 10. In other embodiments, the operator interface is remote from the wrapping machine 1.

The controller 60 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping machine 1 (such as to carry out a wrapping operation, as described below).

The controller 60 is communicatively connected to the first, second, and third sensors 344*a*, 344*b*, and 344*c* to receive signals from these sensors. The controller 60 is communicatively and operably connected to the guide actuator 30, the cutting-and-fixing g device, the film-feed actuator 210, the roping actuator M, and the wrapping-assembly actuator 400 to control operation of these components in conjunction with the wrapping operation, as described below. The controller 60 is communicatively connected to the operator interface 50 to: (1) receive signals from the operator interface 50 that represent inputs received by the operator interface 50; and (2) send signals to the operator interface 50 to cause the operator interface 50 to output (such as to display) information.

A wrapping operation in which the wrapping machine 1 is used to wrap the load L the film F and to use the film F in rope form to secure the load L to the pallet P is now described.

Initially, the circular guide 20 is at its upper position, the cutting-and-fixing device holds the leading end of the film F on the roll R, and the first and second roping components 380 and 390 of the roping assembly 350 of the roping carriage 300 of the wrapping assembly 40 are in the full-width configuration (FIG. 14). The controller 60 controls the conveyor C to move the load L on the pallet P through the infeed area 10*a* and into the wrapping area of the wrapping machine 1.

After the load L on the pallet P reaches the wrapping area, the controller 60 controls the guide actuator 30 to lower the circular guide 20 such that the wrapping assembly 40 is at least partially vertically aligned with part of the load L. The controller 60 controls the cutting-and-fixing device to hold the leading end of the film F against the load L while controlling the wrapping-assembly actuator 400 to rotate the wrapping assembly 40 relative to the circular guide 20 and the load L. The rotation of the wrapping assembly 40 relative to the load L combined with the cutting-and-fixing device holding the leading end of the film F against the load L causes the film F to be drawn off of the roll R, directed through the rollers of the film carriage 200 and the roping carriage 300 and wrapped around the load L.

Figure 16:
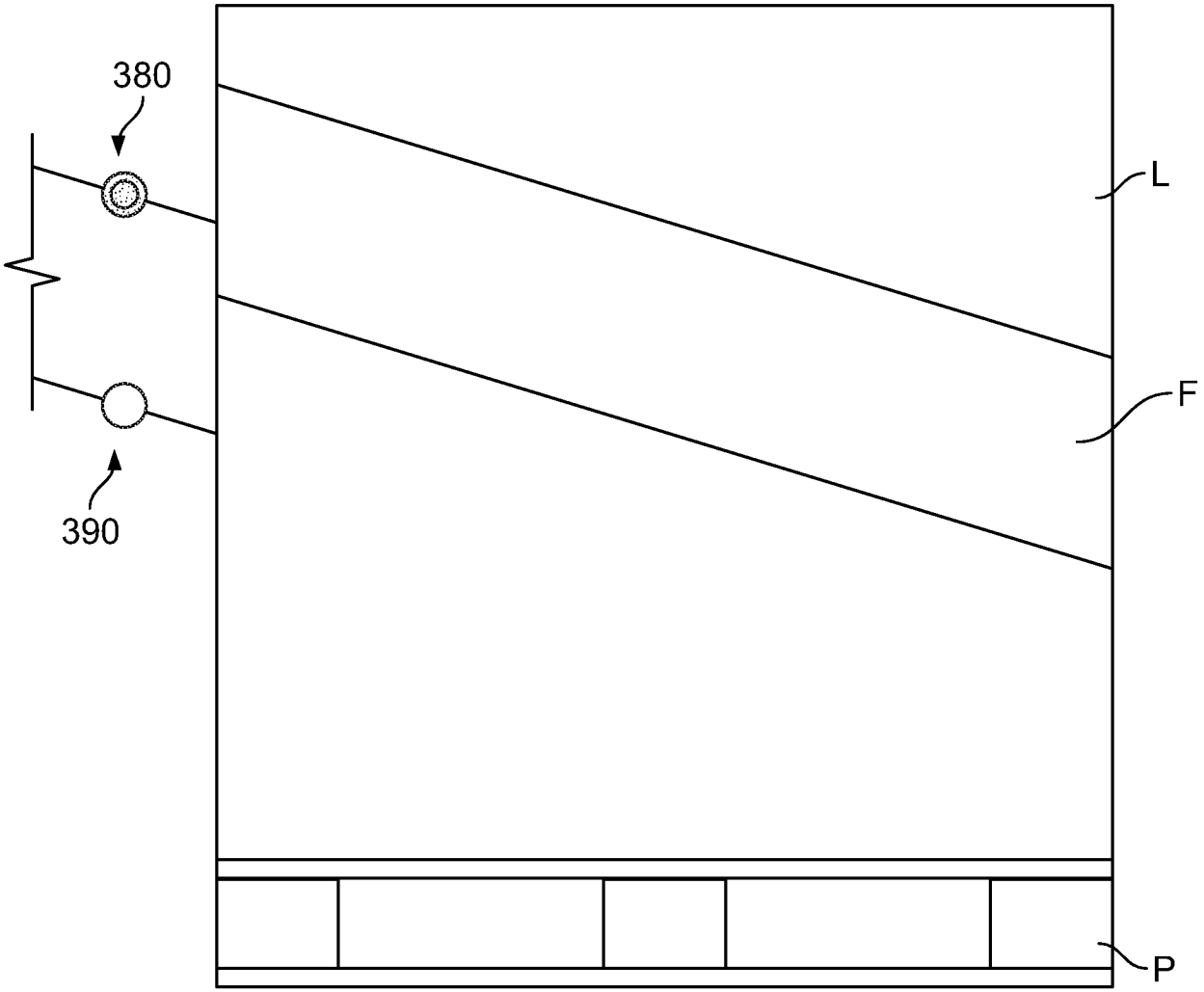
FIG. 16 is a front elevational view of a load on a pallet and being wrapped with film by the roping carriage of FIG. 5 while the first and second roping components are in the full-width configuration.

Once the film F has been wrapped around the leading end, the controller 60 controls the cutting-and-fixing device to release the leading end and move away from the load L. The controller 60 continues to control the wrapping-assembly actuator 400 to rotate the wrapping assembly 40 while controlling the guide actuator 30 to vertically move the circular guide 20 such that the load L is wrapped with the film F in a spiral pattern. During wrapping the controller 60 also controls the film-feed actuator 210 to control the feed rate of the film F and/or to pre-stretch the film F FIG. 16 illustrates this stage of the wrapping operation during which the film F at its full width is wrapped around the load L.

Near the end of the wrapping operation (at least in this example embodiment), the controller 60 controls the wrapping machine 1 to rope the load L to the pallet P. The controller 60 controls the guide actuator 30 to move the circular guide 20 to its lower position near the lower end of the load L. The controller 60 controls the roping actuator M to cause the first and second roping components 380 and 390 to begin moving from their full-width configuration to their roping configuration. Specifically, the controller 60 controls the roping actuator M to cause the first roping component 380 to begin moving from its upper position to its lower position and the second roping component 390 to begin moving from its lower position to its upper position.

Figure 17:
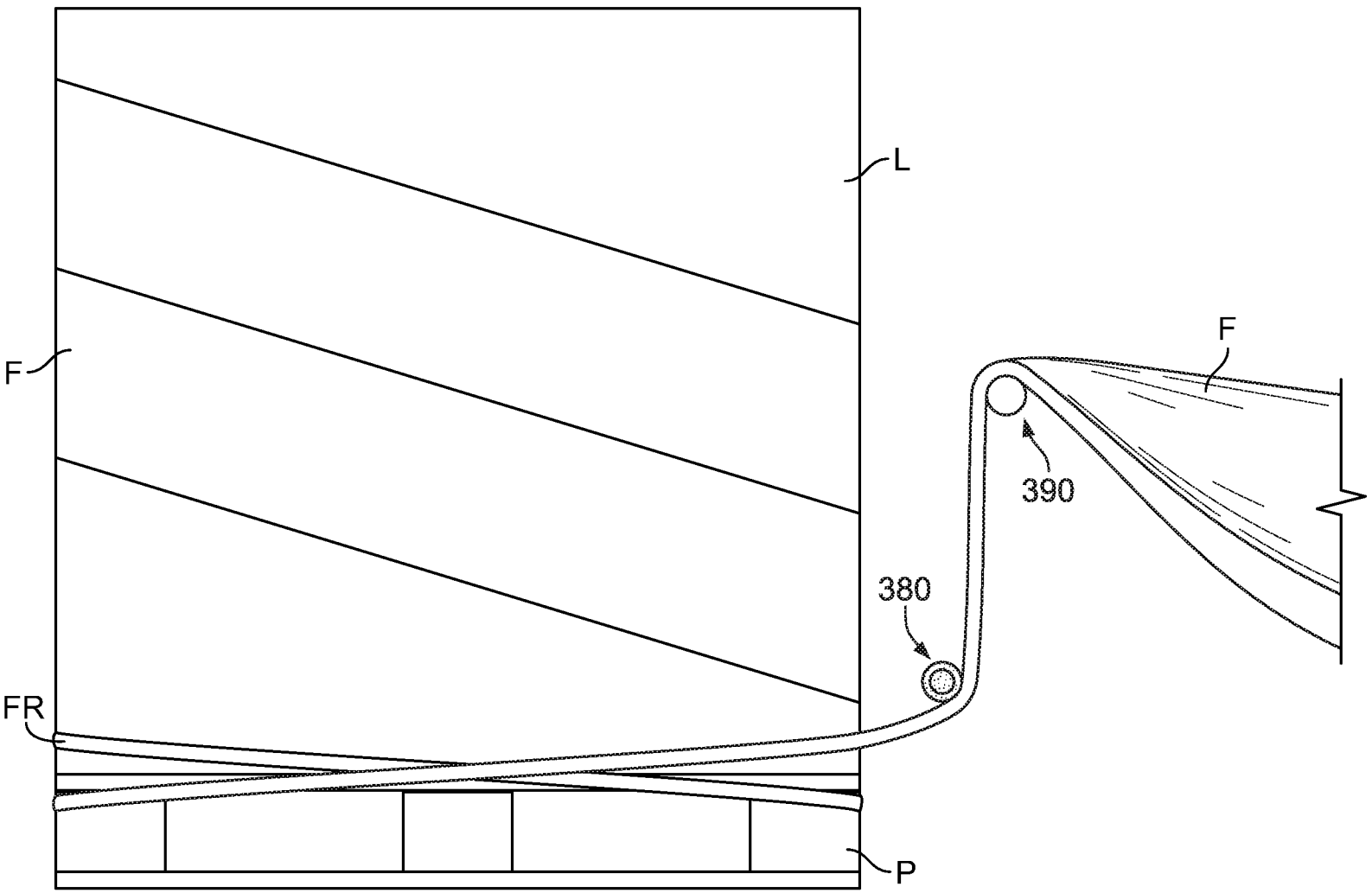
FIG. 17 is a front elevational view of the load on the pallet of FIG. 16 being wrapped with film by the roping carriage of FIG. 5 while the first and second roping components are in the roping configuration.

As the roping components move, the roller 383 of the first roping component 380 contacts the upper end of the film F and pushes it downward while the roller 393 of the second roping component 390 contacts the lower end of the film F and pushes it upward. Continued movement of the roping components 380 and 390 to the roping configuration cause them to swap vertical positions such that, when in the roping configuration (FIG. 15), the roller 383 of the first roping component 380 is below the roller 393 of the second roping component 390. As the first and second roping components 380 and 390 reach their respective lower and upper positions (and together reach the roping configuration), the third sensor 344*c* and the first sensor 344*a* sense the presence of the first and second roping components 380 and 390, respectively. The sensors send corresponding signals to the controller 60, which controls the roping actuator M to cease operation. Movement of the roping components 380 and 390 from the full-width configuration to the roping configuration manipulates the film F into a rope form that has a width $W_2$ that is substantially smaller than the full width $W_1$ of the film F In various embodiments, $W_1$, is about 50% of $W_1$, about 25% of $W_1$, about 10% of $W_1$, about 5% of $W_1$, about 2% of $W_1$, about 1% of $W_1$, or any other suitable fraction of $W_1$. FIG. 17 illustrates this stage of the wrapping operation during which the film in its rope form FR is wrapped around the load L and the pallet P.

When in the roping configuration, the roller 383 of the first roping component 380 extends below the first plate 312 of the roping-carriage frame 310 and below the pallet/load interface. This enables the wrapping machine 1 to use the film in rope form FR to secure the load L to the pallet P without having to raise the load L and the pallet P above the conveyor C. Raising the load is not possible in certain prior art wrapping machines if the load is above a certain mass. After the roller components 380 and 390 have moved to the roping configuration, the controller 60 controls the guide actuator 30 and the wrapping-assembly actuator 400 to secure the load L to the pallet P using the film F in rope form. While securing the load L to the pallet P, the controller 60 may control the roping actuator M to alternately slightly raise and lower the first roping component 380 (and thus alternately slightly lower and raise the second roping component 390) to achieve a desired pattern of the film in rope form FR to properly secure the load L to the pallet P.

Afterwards, the controller 60 controls the roping actuator M to move the roller components 380 and 390 back to the full-width configuration (stopping when the first and third sensors 344*a* and 344*c* detect the presence of the second and first roller components, respectively), which causes the film F to return to its full-width form. The controller 60 then controls the cutting-and-fixing g device to cut the film F from the roll and secure the trailing end of the film F to the load L, thereby completing the wrapping operation. The controller 60 controls the conveyor C to move the wrapped load L and pallet P from the wrapping area and through the outfeed area 10*b*.

In other embodiments, the strapping machine includes two roping actuators configured to independently move the first and second roping components: a first roping actuator operably connected to the first roping component to move the first roping component between an upper position and a lower position and a second roping actuator operably connected to the second roping component to move the second roping component between an upper position and a lower position. In these embodiments, the first and second roping components are not operably connected to one another (as they are via the flexible drive member 376 in the illustrated embodiment described above) such that the first and second roping components are movable relative to one another independently of one another via their respective first and second roping actuators. In these embodiments, the controller is operably connected to the first and second roping actuators to control the first and second roping actuators to move the respective first and second roping components.

Certain embodiments of the wrapping machine of the present disclosure comprise a frame that defines a wrapping area; and a wrapping assembly positioned at least partially within the wrapping area. The wrapping assembly comprises a carriage comprising a mounting plate, a first roping component comprising a first roping roller, and a roping actuator operably connected to the first roping component to move the first roping component relative to the mounting plate between an upper position in which the first roping roller is above the mounting plate to a lower position in which the first roping roller is below the mounting plate.

In certain such embodiments, the wrapping machine further comprises a controller operably connected to the roping actuator to control the roping actuator to operate to move the first roping component from the upper position to the lower position.

In certain such embodiments, the wrapping machine further comprises a drive element. The first roping component is fixedly connected to part of the drive element to move therewith. The roping actuator is operably connected to the drive element to move the drive element to cause the first roping component to move between the upper position and the lower position.

In certain such embodiments, the carriage further comprises a rail to which the first roping component is slidably mounted.

In certain such embodiments, the wrapping machine further comprises a second roping component comprising a second roping roller. The roping actuator is operably connected to the second roping component to move the second roping component relative to the mounting plate between an upper position and a lower position.

In certain such embodiments, the first and second roping rollers are in a full-width configuration when in their respective upper and lower positions and in a roping configuration when in their respective lower and upper positions.

In certain such embodiments, the roping actuator is operably connected to the first and second roping components to move the first and second roping components between the full-width and roping configurations.

In certain such embodiments, the roping assembly further comprises a drive element. The first roping component is fixedly connected to a first part of the drive element to move therewith. The second roping component is fixedly connected to a second part of the drive element to move therewith. The roping actuator is operably connected to the drive element to move the drive element to cause the first and second roping components to simultaneously move from the full-width configuration in which the first roping component is in its upper position and the second roping component is in its lower position to the roping configuration in which the first roping component is in its lower position and the second roping component is in its upper position.

In certain such embodiments, the wrapping machine further comprises a controller operably connected to the roping actuator to control the roping actuator to operate to move the first and second roping components between the full-width and roping configurations.

In certain such embodiments, the carriage further comprises one or more sensors communicatively connected to the controller and configured to detect the positions of the first and second roping components and to generate and send signals representative of the detected positions to the controller.

In certain such embodiments, the controller is configured to control the roping actuator responsive to receipt of the signals.

In certain such embodiments, the first and second roping components are positioned to move past one another when moving between the full-width and roping configurations.

In certain such embodiments, the wrapping machine further comprises a second roping actuator and a second roping component comprising a second roping roller. The second roping actuator is operably connected to the second roping component to move the second roping component relative to the mounting plate and the first roping component between an upper position and a lower position.

In various embodiments, a method of wrapping a load on a pallet comprises: while a first roping component of a carriage is in an upper position above a mounting plate of the carriage, wrapping film having a first width around the load via relative rotation between the carriage and the load; moving the first roping component from the upper position to a lower position in which the first roping component is below the mounting plate to cause a roller of the first roping component to contact the film and manipulate the film into a rope form having a second width that is less than the first width; and afterwards, wrapping the film in the rope form around the load and the pallet via relative rotation between the carriage and the load to secure the load to the pallet.

In certain such embodiments, the method further comprises wrapping the film having the first width around the load via relative rotation between the carriage and the load while the first roping component is in the upper position and a second roping component is in a lower position; and while moving the first roping component from the upper position to the lower position, moving the second roping component from the lower position to an upper position to cause a roller of the second roping component to contact the film and, along with the roller of the first roping component, manipulate the film into the rope form.

The invention claimed is:

1. A wrapping machine comprising:

a frame that defines a wrapping area; and a wrapping assembly positioned at least partially within the wrapping area and comprising:

a carriage comprising:

a first mounting plate;

a second mounting plate below the first mounting plate;

one or more idler rollers extending between and supported by at least one of the first and second mounting plates;

a drive element;

a first roping component comprising a first roping roller, the first roping component fixedly connected to a first part of the drive element to move therewith;

a second roping component comprising a second roping roller, the second roping component fixedly connected to a second part of the drive element to move therewith; and a roping actuator operably connected to the drive element to move the drive element to cause the first roping component and the second roping component to simultaneously move from a full-width configuration in which the first roping component is in an upper position and the second roping component is in a lower position to a roping configuration in which the first roping component is in a lower position and the second roping component is in an upper position, wherein when the first roping component is in its upper position the first roping roller is above the second mounting plate, wherein when the first roping component is in its lower position the first roping roller is below the second mounting plate.

2. The wrapping machine of claim 1, further comprising a controller operably connected to the roping actuator to control the roping actuator to operate to move the first and second roping components from the full-width configuration to the roping configuration.

3. The wrapping machine of claim 2, wherein the carriage further comprises one or more sensors communicatively connected to the controller and configured to detect the positions of the first and second roping components and to generate and send signals representative of the detected positions to the controller.

4. The wrapping machine of claim 3, wherein the controller is configured to control the roping actuator responsive to receipt of the signals.

5. The wrapping machine of claim 1, wherein the carriage further comprises a first rail to which the first roping component is slidably mounted and a second rail to which the second roping component is slidably mounted.

6. The wrapping machine of claim 1, wherein the first and second roping components are positioned to move past one another when moving between the full-width and roping configurations.

7. The wrapping machine of claim 1, wherein the first roping component is below the second roping component when the first roping component is in its lower position and the second roping component is in its upper position.

8. The wrapping machine of claim 7, wherein the first roping component is below the second roping component when the first roping component is in its lower position.

9. A method of wrapping a load on a pallet, the method comprising:

while a first roping component of a carriage comprising a first mounting plate, a second mounting plate, and one or more idler rollers extending between and supported by at least one of the first and second mounting plates is in an upper position in which a first roping roller of the first roping component is above the second mounting plate, wrapping film having a first width around the load via relative rotation between the carriage and the load;

moving the first roping component from the upper position to a lower position in which the first roping roller is below the second mounting plate to cause the first roping roller to contact the film and manipulate the film into a rope form having a second width that is less than the first width; and afterwards, wrapping the film in the rope form around the load and the pallet via relative rotation between the carriage and the load to secure the load to the pallet.

10. The method of claim 9, further comprising:

wrapping the film having the first width around the load via relative rotation between the carriage and the load while the first roping component is in the upper position and a second roping component is in a lower position; and while moving the first roping component from its upper position to its lower position, moving the second roping component from its lower position to an upper position to cause a second roping roller of the second roping component to contact the film and, along with the first roping roller of the first roping component, manipulate the film into the rope form.

11. The method of claim 10, wherein moving the first and second roping components from their respective upper and lower positions to their respective lower and upper positions comprises moving the first and second roping components such that they move past one another.

12. The method of claim 10, wherein the first roping component is below the second roping component when the first roping component is in its lower position and the second roping component is in its upper position.

13. The method of claim 12, wherein the first roping component is below the second roping component when the first roping component is in its lower position.

* * * * *